US005901907A

United States Patent [19]

Hildebrandt

[11] Patent Number: 5,901,907

[45] Date of Patent: May 11, 1999

[54] TWO-CHANNEL TOP DEVICE FOR A SPRAY CAN FOR MAKING TWO SPRAY PATTERNS

[75] Inventor: Bodo Hildebrandt, Riedstadt, Germany

[73] Assignee: Wella Aktiengesellschaft, Darmstadt, Germany

[21] Appl. No.: 08/972,164

[22] Filed: Nov. 17, 1997

[30] Foreign Application Priority Data

Nov. 16, 1997 [DE] Germany ..... 196 47 445

[51] Int. Cl.[6] ..... B05B 7/32; B65D 83/00

[52] U.S. Cl. ..... 239/337; 222/402.1; 222/402.17; 222/402.24

[58] Field of Search ..... 239/337, 349; 222/402.1, 402.17, 402.24, 485

[56] References Cited

U.S. PATENT DOCUMENTS

| | | | |
|---|---|---|---|
| 2,797,965 | 7/1957 | McKernan | 239/337 |
| 3,180,536 | 4/1965 | Meshberg | 222/402.17 X |
| 3,292,827 | 12/1966 | Frangos | 222/402.17 X |
| 5,183,189 | 2/1993 | Baudin | 222/402.24 X |
| 5,735,465 | 4/1998 | Laforcade | 239/337 |

FOREIGN PATENT DOCUMENTS 29 45 600 5/1980 Germany .

*Primary Examiner*—Andres Kashnikow
*Assistant Examiner*—Robin O. Evans
*Attorney, Agent, or Firm*—Michael J. Striker

[57] ABSTRACT

The two-channel top device for a spray can for making two different spray patterns is provided with an operating rod (11) having two connecting ducts (21,22) associated with the respective spray patterns, a manually-operated spray activating button (14) arranged on the operating rod (11) which is provided with two different nozzles (15,16) for the respective spray patterns, the connecting ducts (21,22) being connected with the respective nozzles and having respective inner openings at different axial positions on the operating rod (11) and a self-locking sealing member (29) slidably mounted on the operating member and movable between stops in the spray can.

10 Claims, 4 Drawing Sheets

TWO-CHANNEL TOP DEVICE FOR A SPRAY CAN FOR MAKING TWO SPRAY PATTERNS

BACKGROUND OF THE INVENTION

The present invention relates to a two-channel top device or spray head for a spray can or container for a composition to be sprayed for the purpose of making two different spray patterns.

This sort of top device for a spray can is known from German Patent Application DE 29 45 600 A1. This known spray head or top device is used to make two different width sprays with a spray valve for a self-maintaining spray. The two-channel top device is designed so that a narrow or bunched stream results when the spray activating button is first pressed down which facilitates combating a single individual When the spray activating button is pressed further down a fan-shaped spray is formed which is usable against several attackers.

In the known two-channel top device the selection of the spray pattern is controlled by a sliding element arranged slidably in the spray activating button, which is slidable inside the button against a compression spring integrated in it. The top device sits with the sliding element on the valve stem of the spray can, which is conveyed again into an open position from a closed position against a compression spring in the interior of the spray can. In an initial position of the sliding element maintained by action of the compression spring in the absence of downward pressure on the spray activating button a liquid duct in the sliding element is connected with a first outlet orifice of the top device and an emission of liquid through the valve of the spray container is prevented.

Since the spring integrated in the spray activating button is stronger than the spring acted on by the valve stem of the spray container, when the spray activating button is pressed down the main valve of the spray container opens first and the sprayed liquid passes to the first orifice or nozzle through the liquid duct via the valve stem. With additional stronger pressure on the spray activating button, the sliding element is then displaced against the action of the compression spring in it, whereby the connection between the liquid duct and the first orifice is broken. Finally the liquid duct is connected with the second spray orifice arranged next to the first orifice, so as to produce another spray pattern.

When the spray activating button is partially released, the sliding element returns again into its initial position, whereby sprayed liquid issues once again from the first orifice. However on completely releasing the spray activating button the valve stem is closed in the container whereby the top device is sealed and all spraying ends.

For head care sprays, e.g. hair spray, a coarse spray with comparatively large aerosol particles and a fine spray comprising a fine spray or mist can be employed as the spray patterns. In this application the different spray patterns should be as selective as possible and should be selected independently of each other. In this connection the top device for the spray can disclosed in DE 29 45 600 A1 is disadvantageous, because a spray process with the first spray pattern—e.g. a coarse spray—necessarily occurs at the beginning and end of the other or second spraying process, e.g. a fine spraying process, because of the way in which the top device is designed.

Furthermore the known top device is comparatively large, since the slider and spring mechanisms are accommodated in it. Also the possible shapes for the spray activating button are limited because of these functioning parts, which is particularly disadvantageous in regard to the trends in packaging style for high priced head care products.

SUMMARY OF THE INVENTION

It is an object of the present invention to provide a two-channel top device or spray head for a spray can for making two different spray patterns which produces no after-sprays with different spray patterns, at least at the end of a spray process having a predetermined spray pattern.

It is another object of the present invention to provide a two-channel top device for a spray can for making two different spray patterns which has a spray activating button which is more compact and accessible.

According to the invention, the two-channel top device for a spray can for making two different spray patterns, comprises a connector housing arranged inside a spray can and provided with a throughgoing passage for a liquid to be sprayed; an operating rod guided slidably in the throughgoing passage between a closed position and two open positions associated with the respective spray patterns and provided with a first connecting duct and second connecting duct associated with the respective two spray patterns, the first and second connecting duct being provided with respective first and second inner openings on a peripheral surface of the operating rod; a sealing element for sealing the throughgoing passage from outside of the connector housing, said operating rod passing through the sealing element; a manually-operable spray activating button mounted on the operating rod and provided with two spray nozzles producing the respective two spray patterns, the two spray nozzles being connected with the respective connecting ducts of the operating rod and a sealing member slidably mounted on the operating rod in the throughgoing passage. The dimensions of the parts of the top device are chosen so that the connecting ducts are not connected to the throughgoing passage in the closed position of the operating rod, the first inner opening of the first connecting duct is open to the throughgoing passage so that the first connecting duct is connected with the throughgoing passage when the operating rod is in the first open position, the first inner opening of the first connecting duct is closed by the sealing member and the second inner opening of the second connecting duct is open to the throughgoing passage so that the second connecting duct is connected with the throughgoing passage when the operating rod is in the second open position and, when the operating rod is drawn back into the closed position, both connecting ducts are returned to a state not connected with the throughgoing passage with the first connecting duct maintained in a closed condition while the operating rod is being drawn back.

The spray activating button itself can be very compact and can be easily constructed because of the integration of the connector housing in the spray can and because of the displacement of the parts of the mechanism which lead to the two-channel function. It only includes the two nozzles for the two different spray patterns which communicate with the connecting ducts in the slidable operating rod. More embodiments exist for the spray activating button.

Although on changing from the closed position into the second open position in order to produce, for example, a fine spray for a short time a spray occurs through the first nozzle using a spray can with the top portion according to the invention, this transient spray is completely block during a transition from the second opening position into the closed position. This is because the connection to the first nozzle is closed by closing the opening of the first connecting duct by the sealing member on the operating rod. When the operating rod is moved to the closed position this opening remains closed by the sealing member as it moves into a position directly under the sealing element of the connector housing so that at no time is the opening of this connecting duct open. An after-spray with the undesired spray pattern is thus prevented.

BRIEF DESCRIPTION OF THE DRAWING

The objects, features and advantages of the invention will now be illustrated in more detail with the aid of the following description of the preferred embodiments, with reference to the accompanying figures, in which.

DESCRIPTION OF THE PREFERRED EMBODIMENTS

Figure 1:
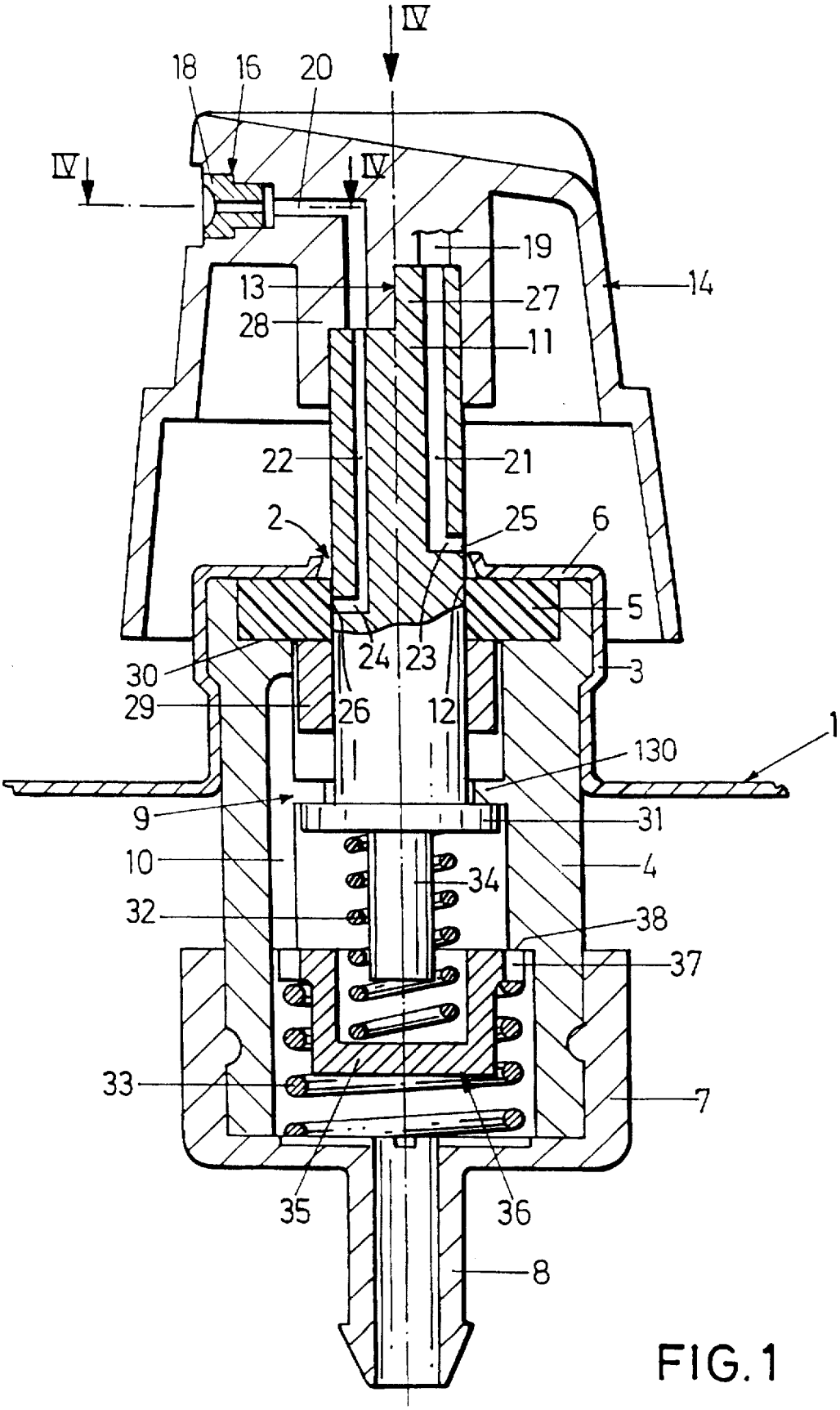
FIGS. 1 to 3 are respective axial cross-sectional views through a two-channel top device according to the invention in a closed configuration, a first open configuration and a second open configuration.
Figure 2:
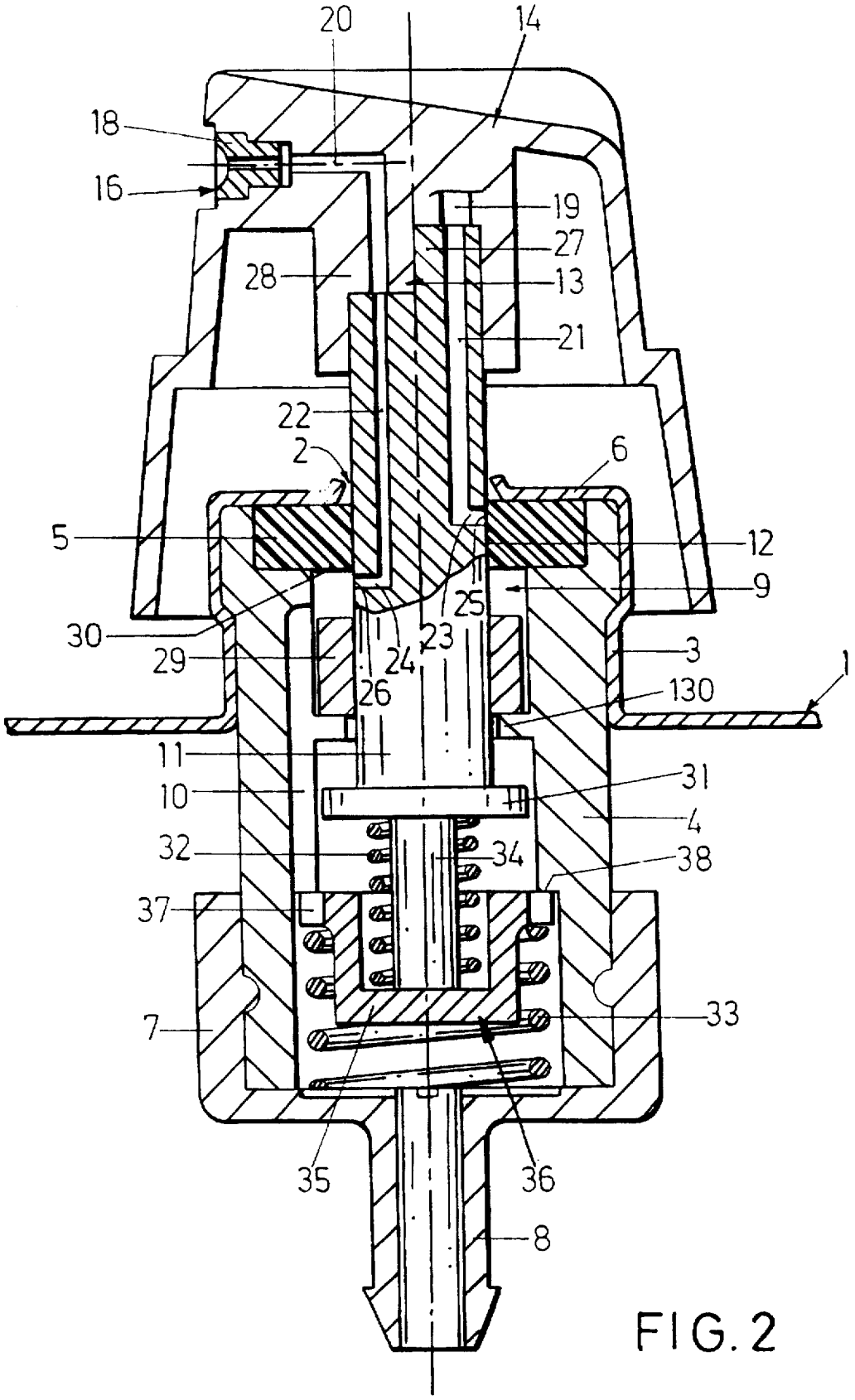
Figure 3:
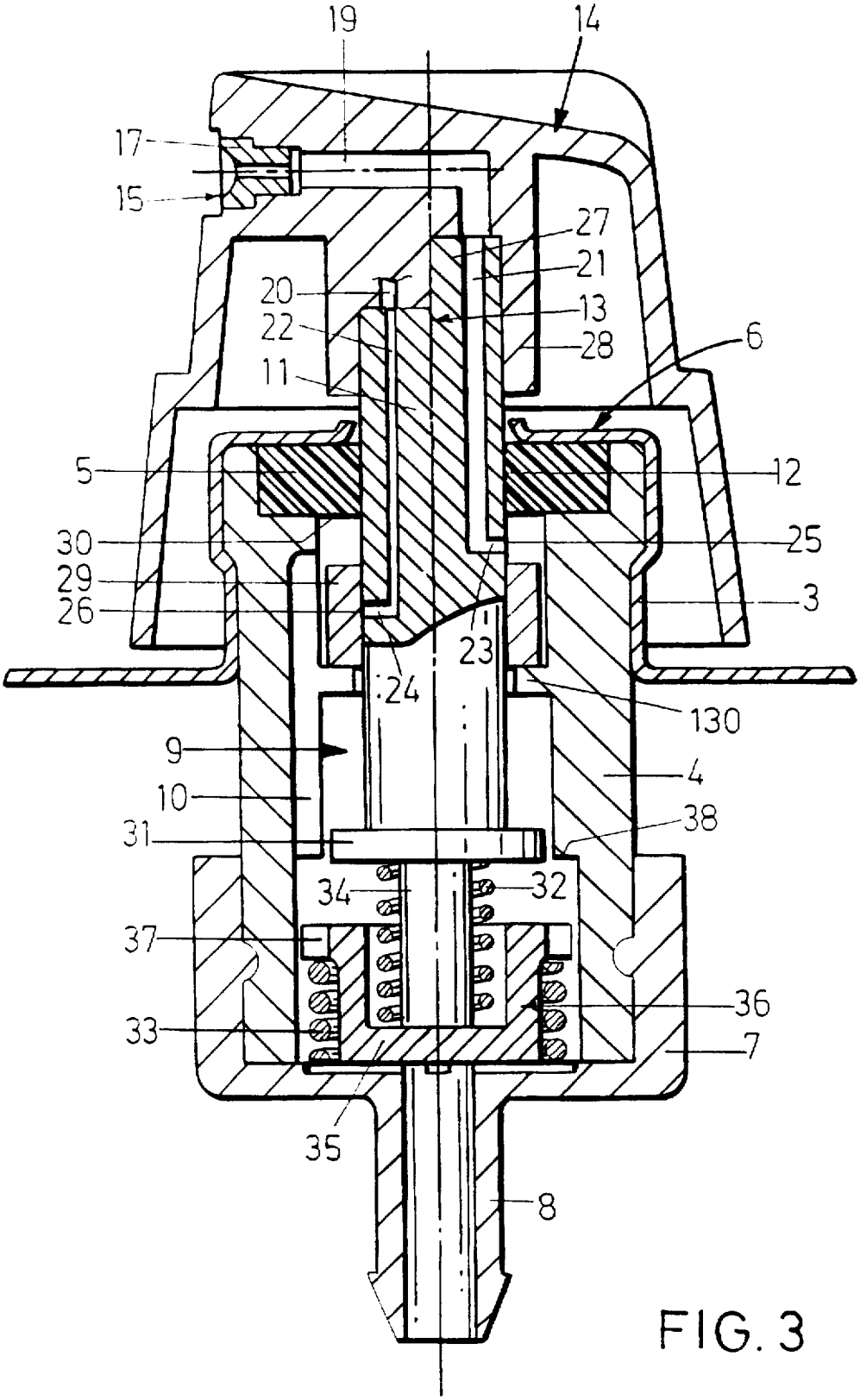
Figure 4:
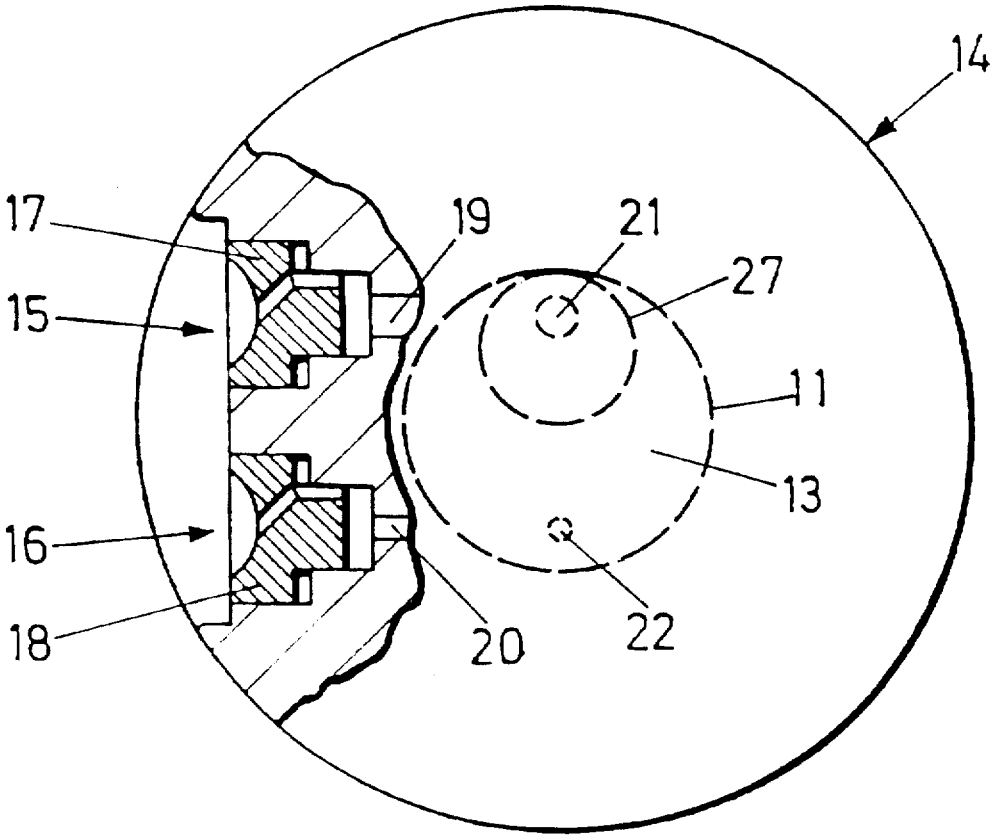
FIG. 4 is a partially cross-sectional, partially top view of a spray activating button from the apparatus of FIG. 1 taken along the line IV—IV and as seen in the direction of the arrows IV.

One embodiment of the top device for the spray can 1 according to the invention is shown in FIGS. 1 to 3 in cross-section. The top end of the spray can has a collar 3 surrounding the spray can opening 2. The substantially cylindrical connector housing 4 is pressed into the collar 3. A circular or ring-shaped sealing element 5 is provided at the upper end of the connector housing 4. The sealing element 5 contacts a circular flanged edge 6 of the collar 3 so that the connector housing 4 is sealed from its outer side.

A housing cap 7 is arranged or sits on the end of the connector housing 4 opposite from that sealed by the sealing element and which is inside the container. The housing cap 7 is provided with a central connector 8 through which liquid from the interior of the can 1 passes. An unshown tube or pipe can be provided on the central connector 8 which reaches to the bottom of the spray container 1 and guarantees a practically complete emptying of the container without leaving a residue in it.

The interior of the connector housing 4 has a throughgoing passage 9 for the liquid entering it through the connector 8 including axially extending longitudinal ducts 10 provided in the interior wall of the connector housing in order to guarantee an unimpeded liquid flow through the operating parts still to be described arranged in the connector housing 4.

The operating rod 11 is the key member of these operating parts and is slidable in the axial direction between the first and second open positions shown in FIGS. 2 and 3 and the closed position shown in FIG. 1 through the opening 12 of the circular sealing member 5. It is guided by the sealing element 5 through the opening 12, and a spray activating button 14 is mounted on its end extending through that opening. Two spray nozzles 15,16 are provided in this top device 14 at the same level beside each other. These spray nozzles 15,16 are provided with respective spray inserts 17,18 made from metal which cause the production of the different spray patterns. For example, a coarse spray with comparatively large particles liquid is produced by the nozzle 15, while the nozzle 16 produces a fine spray mist or fog.

Both nozzles 15,16 are connected by respective connecting ducts 21,22 in the operating rod 11 by means of the respective parallel, bent duct branches 19,20 in the spray activating button. These connecting ducts 21,22 extend from the end 13 of the operating rod 11 axially parallel until approximately in the middle of the operating rod 11, where they open onto the outer wall or peripheral surface of the operating rod 11 at different axial positions or heights by means of the short connecting branches 23,24. The second opening 25 connected with the nozzle 15 by means of the second connecting duct 21 is arranged several millimeters above the first opening 26 which is connected with the nozzle 16 by means of the first connecting duct 22.

As further clearly shown in the added figures, the second connecting duct 21 with a comparatively larger diameter extends through a cylindrical projection 27 arranged eccentrically to the operating rod 11 and extending from its upper end 13. The opposing piece 28 on the inside of the spray activating button 14 has a complementary negative form at the upper end 13 of the operating rod 11, so that a definite bearing and connection of the connecting ducts 21,22 on the associated connecting branches 19,20 is made by simply pushing the spray activating button 14 on the operating rod 11.

A ring-shaped sealing element 29 is provided inside the connector housing 4 on the operating rod 11, which is axially slidable, but self-locking, on the operating rod 11. The sealing element 29 is movable with the operating rod 11 in the ring space provided between the sealing member 5 which forms essentially a first housing stop 30 for it and a second housing stop 130 on the connector housing 4. However the sealing element 29 slides on the operating rod 11 when it engages with the second housing stop 130.

The second housing stop 130 simultaneously acts as a stop for a collar-like opposing stop 31 on the operating rod 11 with its side facing way from the sealing element 29, whereby the closed position shown in FIG. 1 of the spraying head is defined. The operating rod 11 is urged into the closed position by the two coil springs 32,33 when the top device is not operated. The first coil spring 32 facing the operating rod 11 is arranged loosely around a coaxial stop pin 34 formed on the inner end of the operating rod 11 and is braced with one of its ends against the opposing stop 31. The opposite end of coil spring 32 sits on the bottom 35 of a cup-like spring cap 36, which sits in a second coil spring 33 provided with a larger diameter and which faces the inner end of the operating rod 11. The second coil spring 33 is braced on a radially extending projection 37 extending radially outward from the upper edge of the spring cap 36, and pushes the spring cap 36 against an inwardly projecting, opposing shoulder 38 of the connector housing 4.

The operation of the top device is now described with reference to FIGS. 1 to 4 as follows:

The closed position shown in FIG. 1—as mentioned above—is maintained by both coil springs 32,33 coupled via the spring cap 36 and coupled with each other acting on the operating rod 11. In the closed position the openings 25,26 of the connecting ducts 21,22 are on the side of the bottom of the sealing member 5 on which they are separated from the throughgoing passage 9 and no liquid flow through the conducting ducts 21,22 is possible.

In order to produce a first spray pattern—for example a fine spray or mist, the spray activating button 14 is pressed down in the direction IV according to FIG. 1, whereby the operating rod 11 is pushed inward. Because of that, the weaker-designed coil spring 32 is compressed against the spring cap 36 which is acted on by the comparatively stronger coil spring 33 in the position shown in FIG. 1. The sliding sealing member 29 is moved into the throughgoing passage 9 together with the operating rod 11 because of its self-locking bearing; also it is moved inwardly away from first housing stop 30 on the sealing element 5. In this connection the first opening 26 moves from the vicinity of the sealing element 5 into the throughgoing passage 9 in the connector housing 4, whereby a liquid connection is made to the fine spray nozzle 16 and a suitable spray mist or fog is produced.

The insertion of the operating rod 11 with a certain predetermined operating force is also limited by the contact of the stop pin 34 on the bottom 35 of the spring cap, as shown in FIG. 2. At this point the user senses a certain predetermined resistance, whereby the first open position shown in FIG. 2 is easily detected. This considerably increases the operator's comfort.

If now the second spray pattern—also e.g. a coarse spray—must be produced, thus the spray activating button 14 must be pressed in beyond the position shown in FIG. 2 which requires a higher force because of the required compression of the stronger-designed coil spring 33. The sliding sealing member 29 is held in place by the second housing stop 130 during this insertion motion and the operating rod 11 moves relative to the sliding sealing member 29. Because of that latter motion, the first opening 26 passes under the sliding sealing member 29 and is thus closed. Thus the fine spray process ends. On further insertion of the operating rod 11 the second opening 25 of the second connecting duct 21 is opened to the throughgoing passage 9, whereby the nozzle 15 is supplied with liquid to be sprayed and a coarse spray process is produced.

In the state or configuration shown in FIG. 3 the bottom 35 of the spring cap 36 contacts or rests on the inner side of the housing cap 7, whereby this end position is clearly defined.

On releasing the spray activating button 14 the operating rod 11 is moved out from the connector housing by action of both coil springs 32,33, but because the self-locking sliding sealing member 29 travels with the operating rod the first opening 26 of the connecting duct 22 remains closed. Simultaneously the second opening 25 of the second connecting duct 21 passes under the sealing element 5 whereby it is similarly closed. Thus each spraying process is blocked. On further drawing back of the operating rod 11 into the closed position shown in FIG. 1, the sliding sealing member 29 finally rests on the stop 30 of the sealing element 5 so that it is fixed in position. When the operating rod 11 is pulled further upward, the opposing stop 31 comes to rest or contact on the second housing stop 130. During this motion the first opening 26 travels from the vicinity of the sliding sealing member 29 to the vicinity of the sealing element 5 and because of that remains continuously closed.

I claim:

1. A two-channel top device for a spray can for making different spray patterns, said top device comprising a connector housing (4) arranged inside a spray can (1) and provided with a throughgoing passage (9) for a liquid to be sprayed;

an operating rod (11) guided slidably in the throughgoing passage (9) between a closed position and two open positions associated with two respective spray patterns and provided with a first and second connecting duct (22,21) associated with the respective two spray patterns, said first and second connecting duct (22,21) having respective first and second inner openings (26, 25);

a sealing element (5) for sealing the throughgoing passage (9) from an exterior of the connector housing (4), said operating rod (11) being guided slidably in said sealing element (5);

a manually-operable spray activating button (14) mounted on the operating rod (11) and provided with two spray nozzles (15,16) including means for producing the respective two spray patterns, said spray nozzles (15, 16) being connected with the respective connecting ducts (22,21) of the operating rod (11); and a sealing member (29) slidably mounted on the operating rod (11);

wherein said correcting ducts (22,21) are not connected with the throughgoing passage (9) in said closed position of said operating rod (11), said first inner opening (26) of said first connecting duct (22) only is open to the throughgoing passage (9) when the operating rod (11) is in the first open position, said first inner opening (26) of said first connecting duct (22) is closed by said sealing member (29) and said second inner opening (25) of said second connecting duct (21) is open to said throughgoing passage (9) when the operating rod (11) is in said second open position and, when the operating rod (11) is being drawn back into said closed position, both of said connecting ducts (21,22) are being returned to a state not connected with the throughgoing passage (9) with the first connecting duct (22) maintained in a closed condition while the operating rod (11) is being drawn back.

2. The two-channel top device as defined in claim 1, wherein the first and second connecting ducts (22,21) open radially with said respective first and second openings (26,25) at respective different axial positions on said operating rod (11).

3. The two-channel top device as defined in claim 1, wherein said connector housing (4) includes a first housing stop (30) and a second housing stop (130) for the sealing member (29) slidably mounted on the operating rod (11) so that said sealing member (29) is slidable between the first and second housing stops (30), said sealing member (26) has self-locking means for self-locking on the operating rod (11) so that when the operating rod (11) is in said closed position the sealing member (29) contacts on the first housing stop (30); when the operating rod (11) is moved into the first open position because of said self-locking means said sealing member (29) is placed in contact with the second housing stop (130); when the operating rod (11) is moved further into the second open position said self-locking means is overcome and said sealing member (29) moves over and closes said first opening (26) of said first connecting duct (22) and when the operating rod (11) is drawn back into said closed position because of said self-locking means said sealing member (29) travels back on said operating rod from a contacting position on said second housing stop (130) to an initial position at said first housing stop while keeping said first inner opening (26) closed.

4. The two-channel top device as defined in claim 3, wherein said first housing stop (30) comprises said sealing element (5) of the connector housing (4).

5. The two-channel top device as defined in claim 3, wherein the operating rod (11) is provided with an opposing stop portion (31) and said opposing stop portion (31) is dimensioned and located on said operating rod to engage said second housing stop (130) thus limiting upward motion of said operating rod (11) and defining said closed position of said operating rod.

6. The two-channel top device as defined in claim 3, further comprising two compression springs (32,33)

arranged around the operating rod (11) in said connector housing (4) so as to urge the operating rod (11) in a direction toward said closed position.

7. The two-channel top device as defined in claim 6, further comprising a spring cup (36) arranged in the connector housing (4) facing a bottom end of the operating rod (4), and wherein both of said compression springs are arranged coupled with each other between an opposing stop (31) on the operating rod (11) and a bottom of the connector housing (4) so that one (32) of said compression springs is braced on a side of said spring cup facing the operating rod and another (33) of the compression springs is braced on the spring cup on an opposite side of said spring cup facing away from the operating rod.

8. The two-channel top device as defined in claim 7, wherein said one (32) of the compression springs is weaker than said another (33) of the compression springs and said one (32) of the compression springs is engaged around a stop pin (34) extending from the bottom end of said operating rod (4) and when said operating rod (4) is in said first open position said stop pin contacts said spring cup (36).

9. The two-channel top device as defined in claim 8, wherein said spring cup (36) has a base (35) limiting downward displacement of the operating rod (4) and defining the second open position of the operating rod (4).

10. The two-channel top device as defined in claim 9, wherein said spring cup (36) is shaped like a beaker.

* * * * *